US011165168B2

(12) United States Patent
Kim

(10) Patent No.: US 11,165,168 B2
(45) Date of Patent: Nov. 2, 2021

(54) ANTENNA APPARATUS

(71) Applicant: Samsung Electro-Mechanics Co., Ltd., Suwon-si (KR)

(72) Inventor: Sang Hyun Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 38 days.

(21) Appl. No.: 16/737,129

(22) Filed: Jan. 8, 2020

(65) Prior Publication Data

US 2021/0036433 A1 Feb. 4, 2021

(30) Foreign Application Priority Data

Jul. 31, 2019 (KR) ..... 10-2019-0093172

(51) Int. Cl.
*H01Q 1/48* (2006.01)
*H01Q 21/06* (2006.01)
(Continued)

(52) U.S. Cl.
CPC ..... *H01Q 21/065* (2013.01); *H01Q 1/48* (2013.01); *H01Q 5/35* (2015.01); *H01Q 21/0025* (2013.01); *H01Q 1/241* (2013.01)

(58) Field of Classification Search
CPC .... H01Q 21/065; H01Q 21/0025; H01Q 5/35; H01Q 1/48; H01Q 1/241; H01Q 21/0075;
(Continued)

(56) References Cited

U.S. PATENT DOCUMENTS 7,079,078 B2 * 7/2006 Yuanzhu ..... H01P 1/38 343/700 MS
7,102,571 B2 * 9/2006 McCarrick ..... H01Q 1/38 343/700 MS
(Continued)

FOREIGN PATENT DOCUMENTS

JP 2008-098919 A 4/2008
KR 10-2007-0014785 * 8/2008
(Continued)

OTHER PUBLICATIONS

Korean Office Action dated Apr. 17, 2020 in corresponding Korean Patent Application No. 10-2019-0093172 (9 pages in English, 6 pages in Korean).
(Continued)

*Primary Examiner* — Jean B Jeanglaude
(74) *Attorney, Agent, or Firm* — NSIP Law

(57) ABSTRACT

An antenna apparatus includes a ground plane; a first patch antenna pattern having a first bandwidth and spaced apart from the ground plane; a second patch antenna pattern spaced apart from the ground plane and the first patch antenna and overlapping at least a portion of the first patch antenna pattern; and guide vias disposed between the first patch antenna pattern and the ground plane and electrically connecting the first patch antenna pattern to the ground plane. The second patch antenna pattern has a second bandwidth corresponding a frequency higher than a frequency of the first bandwidth. The guide vias are disposed along a first side of the first patch antenna pattern.

16 Claims, 14 Drawing Sheets

(51) Int. Cl.
*H01Q 21/00* (2006.01)
*H01Q 5/35* (2015.01)
*H01Q 1/24* (2006.01)

(58) Field of Classification Search
CPC ..... H01Q 5/385; H01Q 1/243; H01Q 9/0414; H01Q 9/0421; H01Q 21/08
USPC ..... 343/848
See application file for complete search history.

(56) References Cited

U.S. PATENT DOCUMENTS

| | | | | |
|---|---|---|---|---|
| 7,940,217 | B2 * | 5/2011 | Howard | H01Q 9/0407 343/700 MS |
| 8,482,466 | B2 * | 7/2013 | Thiam | H01Q 21/28 343/700 MS |
| 8,659,498 | B2 * | 2/2014 | Rothwell | H01Q 9/0442 343/876 |
| 9,419,338 | B2 * | 8/2016 | Chiu | H01Q 5/378 |
| 10,826,172 | B2 * | 11/2020 | Kim | H01Q 1/48 |
| 2009/0009399 | A1 * | 1/2009 | Gaucher | H01Q 21/0006 343/700 MS |
| 2010/0022181 | A1 * | 1/2010 | Ly | H01Q 9/0421 455/1 |
| 2014/0225803 | A1 * | 8/2014 | Huerta | H01Q 1/428 343/872 |
| 2015/0194734 | A1 * | 7/2015 | Chiu | H01Q 9/0421 343/767 |
| 2016/0079672 | A1 * | 3/2016 | Cerreno | H01Q 21/065 343/848 |
| 2019/0165472 | A1 | 5/2019 | Yun et al. | |

FOREIGN PATENT DOCUMENTS

| | | | |
|---|---|---|---|
| KR | 10-2008-0075628 | A | 8/2008 |
| KR | 10-1572037 | B1 | 11/2015 |
| KR | 10-1954000 | B1 | 3/2019 |
| KR | 101954000 | * | 3/2019 |
| KR | 10-2019-0062064 | A | 6/2019 |

OTHER PUBLICATIONS

Li et al., "Development and Analysis of a Folded Shorted-Patch Antenna With Reduced Size," IEEE Transactions on Antennas and Propagation, vol. 52, No. 2, Feb. 2004, pp. 555-562.

Klionovski et al., "Physically Connected Stacked Patch Antenna Design With 100% Bandwidth," IEEE Antennas and Wireless Propagation Letters, vol. 16, 2017, pp. 3208-3211.

* cited by examiner

ANTENNA APPARATUS

CROSS-REFERENCE TO RELATED APPLICATION(S)

This application claims the benefit under 35 USC 119(a) of Korean Patent Application No. 10-2019-0093172 filed on Jul. 31, 2019 in the Korean Intellectual Property Office, the entire disclosure of which is incorporated herein by reference for all purposes.

BACKGROUND

1. Field

The following description relates to an antenna apparatus.

2. Description of Background

Mobile communications data traffic has increased on an annual basis. Various techniques have been developed to support the rapid increase in data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images at a user viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

A radio frequency RF signal of a high frequency band (e.g., 24 GHz, 28 GHz, 36 GHz, 39 GHz, 60 GHz, and the like) may easily be absorbed and lost during transmission, which may degrade quality of communications. Thus, an antenna for communications performed in a high frequency band may require a technical approach different from techniques used in a general antenna, and a special technique such as a separate power amplifier, and the like, may be required to secure antenna gain, integration of an antenna and a radio frequency integrated circuit (RFIC), effective isotropic radiated power (EIRP), and the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An antenna apparatus that may improve antenna performance (e.g., a gain, a bandwidth, directivity, etc.) and/or may be easily miniaturized.

In one general aspect, an antenna apparatus includes a ground plane; a first patch antenna pattern having a first bandwidth and spaced apart from the ground plane; a second patch antenna pattern spaced apart from the ground plane and the first patch antenna and overlapping at least a portion of the first patch antenna pattern; and guide vias disposed between the first patch antenna pattern and the ground plane and electrically connecting the first patch antenna pattern to the ground plane. The second patch antenna pattern has a second bandwidth corresponding a frequency higher than a frequency of the first bandwidth. The guide vias are disposed along a first side of the first patch antenna pattern.

The guide vias may include three or more guide vias, and the guide vias may be arranged linearly.

The first patch antenna pattern may have a polygonal shape, and the guide vias may be arranged to open sides of the first patch antenna pattern other than the first side.

At least a portion of the guide vias may overlap a boundary of the second patch antenna pattern.

The second patch antenna pattern may be spaced apart from the ground plane more than the first patch antenna pattern such that the first patch antenna pattern is disposed between the second patch antenna pattern and the ground plane, and a spacing distance between the first patch antenna pattern and the second patch antenna pattern may be less than a spacing distance between the first patch antenna pattern and the ground plane.

The second bandwidth may include 60 GHz, and a central frequency of the first bandwidth may be included in a range of 20 GHz to 40 GHz.

A length of the first patch antenna pattern taken in a first direction may be 0.8 to 1.2 times a length of the second patch antenna pattern taken in the first direction.

The antenna apparatus may include a feed via electrically connected to the second patch antenna pattern, and the first patch antenna pattern may include a through-hole through which the feed via penetrates.

The feed via may be disposed adjacent to the plurality of guide vias and offset from a center of the first patch antenna pattern.

The antenna apparatus may include a feed pattern electrically connected to the feed via and disposed in the through-hole of the first patch antenna pattern, and the feed pattern may have a width greater than a width of the feed via.

The guide vias may be separated from the second patch antenna pattern.

In another general aspect, an antenna apparatus includes a ground plane; first patch antenna patterns each having a polygonal shape and being spaced apart from the ground plane; and guide vias disposed between the first patch antenna patterns and the ground plane and electrically connecting the first patch antenna patterns to the ground plane. The guide vias are arranged to open first sides of the first patch antenna patterns that do not oppose each other, and are arranged along second sides opposing the first sides of the first patch antenna patterns.

The first patch antenna patterns may be arranged in a first direction, and a second direction from the second side to the first side of each of the first patch antenna patterns may be different from the first direction.

The antenna apparatus may include second patch antenna patterns spaced apart from the first patch antenna patterns, and a spacing distance between the first patch antenna patterns and the second patch antenna patterns may be less than a spacing distance between the first patch antenna patterns and the ground plane.

The antenna apparatus may include feed vias electrically connected to the second patch antenna patterns, each of the first patch antenna patterns may include a through-hole through which a corresponding feed via of the feed vias penetrates, and the feed vias may indirectly feed power to a corresponding first patch antenna pattern.

The antenna apparatus may include feed lines electrically connected to a corresponding feed via of the feed vias and spaced apart from the ground plane, and the ground plane may include at least one through-hole through which the feed vias penetrate.

In another general aspect, an antenna apparatus includes a ground plane; a first patch antenna pattern spaced apart from the ground plane in a first direction; a second patch antenna pattern spaced apart from the ground plane in the first direction and overlapping at least a portion of the first patch antenna pattern such that the first patch antenna pattern is disposed between the second patch antenna pattern and the ground plane in the first direction; and guide vias electrically connecting the first patch antenna pattern to the ground plane and disposed linearly along a first surface of the first patch antenna pattern that is substantially perpendicular to the first direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
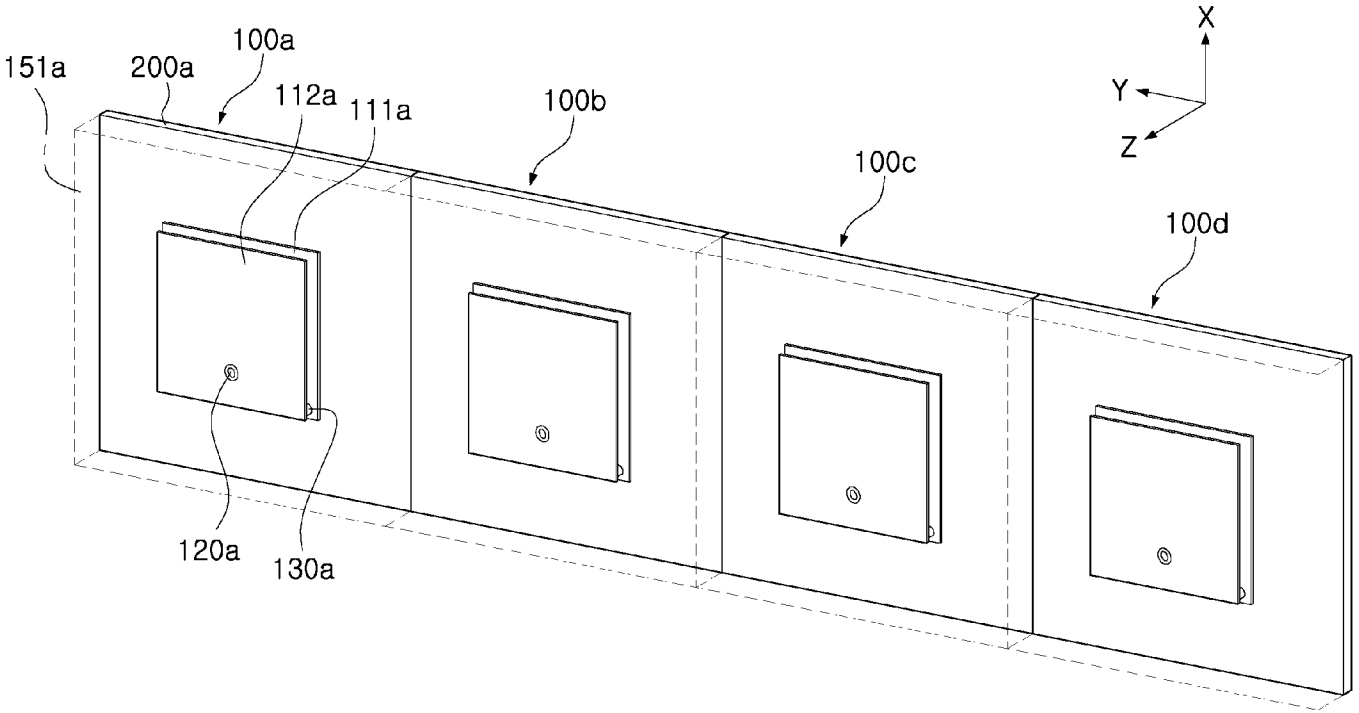
FIG. 1 is a perspective view illustrating an antenna apparatus according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and examples are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative sizes, proportions, and depictions of elements in the drawings may be exaggerated for clarity, illustration, and convenience.

Hereinafter, examples will be described with reference to the attached drawings.

Figure 2A:
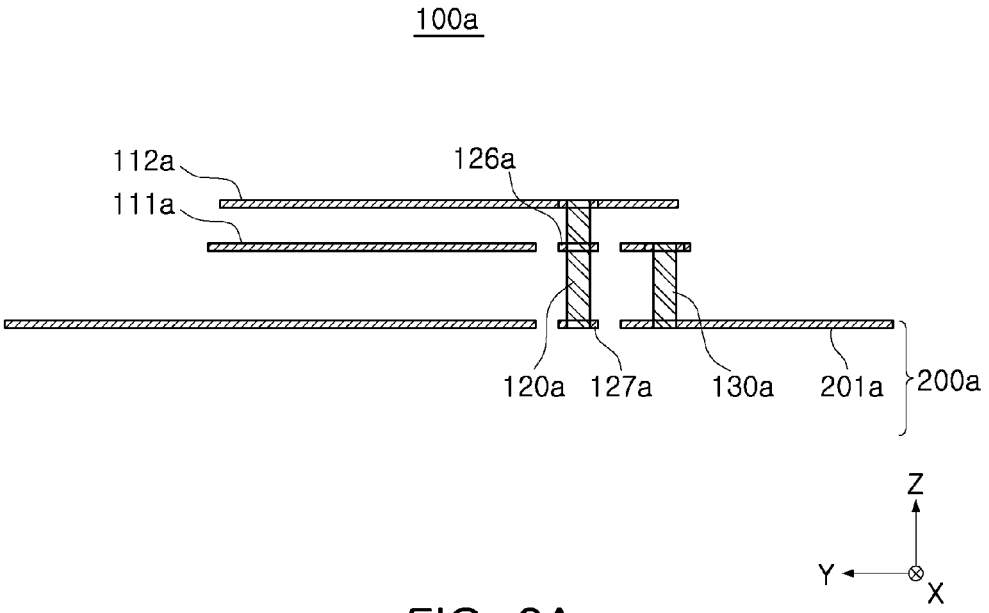
FIG. 2A is a cross-sectional view illustrating an antenna apparatus according to an example.
Figure 2B:
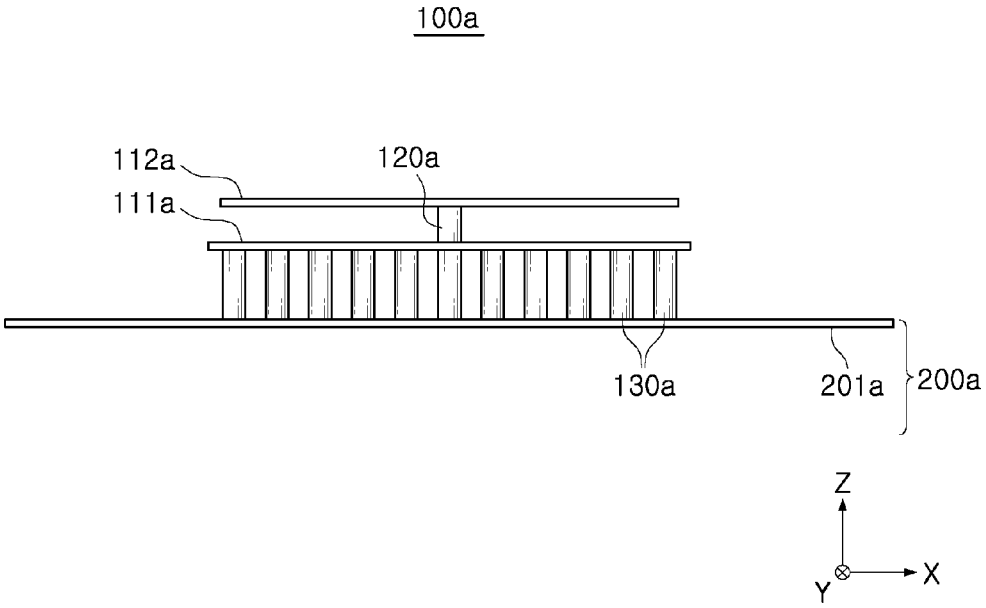
FIG. 2B is a side view illustrating an antenna apparatus according to an example.
Figure 3A:
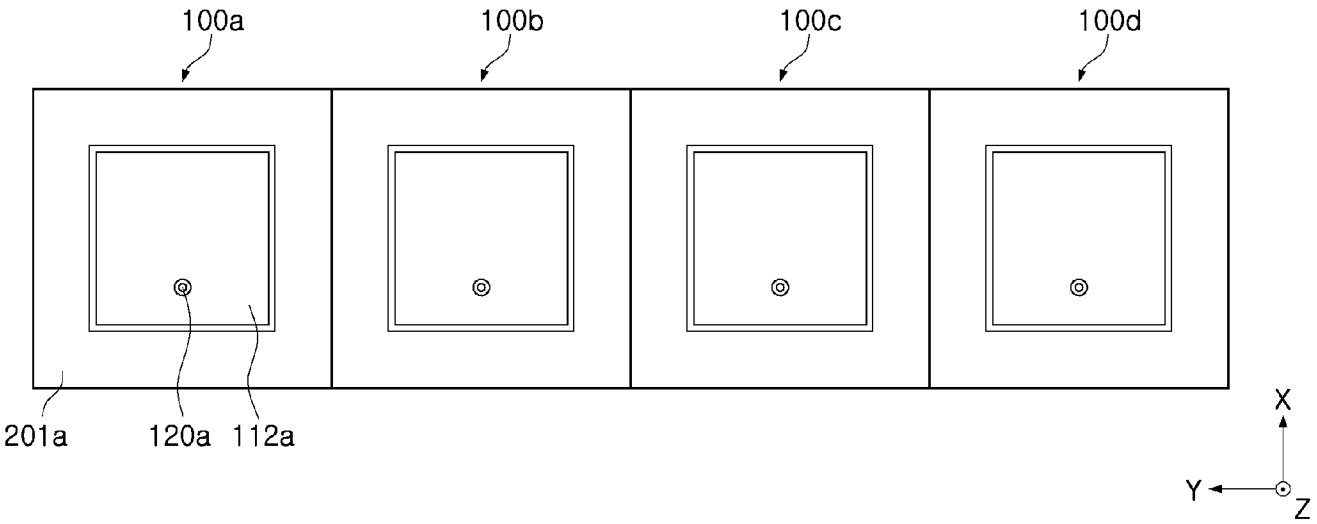
FIG. 3A is a plan view illustrating an antenna apparatus and a second patch antenna pattern according to an example.
Figure 3B:
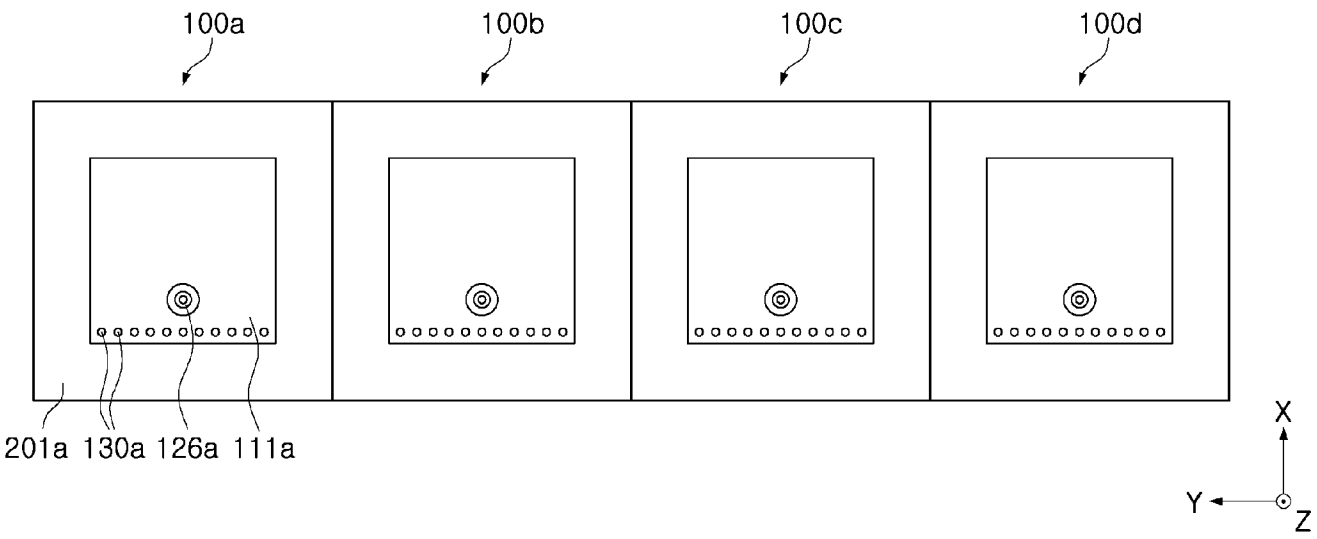
FIG. 3B is a plan view illustrating an antenna apparatus and a first patch antenna pattern according to an example.

FIG. 1 is a perspective view illustrating an antenna apparatus according to an example. FIG. 2A is a cross-sectional view illustrating an antenna apparatus according to an example. FIG. 2B is a side view illustrating an antenna apparatus according to an example. FIG. 3A is a plan view illustrating an antenna apparatus and a second patch antenna pattern according to an example. FIG. 3B is a plan view illustrating an antenna apparatus and a first patch antenna pattern according to an example.

Referring to FIGS. 1, 2A, 2B, 3A, and 3B, antenna apparatuses 100*a*, 100*b*, 100*c*, and 100*d* may include a ground plane 201*a*, a first patch antenna pattern 111*a*, a second patch antenna pattern 112*a*, and a plurality of guide vias 130*a*, and may further include at least one of a feed via 120*a*, a feed pattern 126*a*, a dielectric layer 151*a*, and a connection member 200*a*.

The first patch antenna pattern 111*a* may be disposed upwardly (+Z axis direction) of the ground plane 201*a*, may be spaced apart from the ground plane 201*a*, and may have a first bandwidth. For example, the first bandwidth may have a central frequency included in a range of 20 GHz or higher and 40 GHz or lower, and may be determined by intrinsic elements of the first patch antenna pattern 111*a* (e.g., a size and a form of the first patch antenna pattern, a spacing distance of the first patch antenna pattern to the other elements, a dielectric constant of the dielectric layer, and the like).

The first patch antenna pattern 111*a* may form a radiation pattern in upward and downward directions (e.g., +/−Z directions) as a surface current flows to an upper surface, and may remotely transmit and receive a radio frequency (RF) signal in the upward and downward directions (e.g., +/−Z directions).

A direction and/or a magnitude of a surface current flowing on the first patch antenna pattern 111*a* may be determined based on impedance (capacitance and/or inductance) corresponding to the intrinsic elements of the first patch antenna pattern 111*a*.

For example, the first patch antenna pattern 111*a* may have a polygonal shape having a plurality of sides. As an electromagnetic boundary condition of the sides of the polygonal shape of the first patch antenna pattern 111*a*, the surface current may flow from one side to the other side of the first patch antenna pattern 111*a*.

The ground plane 201*a* may be disposed on a lower side of the first patch antenna pattern 111*a*, may be spaced apart from the first patch antenna pattern 111*a*, and may overlap the first patch antenna pattern 111*a* in the upward and downward directions (e.g., +/−Z directions).

The ground plane 201*a* may be included in the connection member 200*a*. For example, the connection member 200*a* may have a structure in which metal layers and insulating layers are alternately layered, similarly to a printed circuit board (PCB).

The ground plane 201*a* may work electromagnetically as a reflector with respect to the first patch antenna pattern 111*a*, and accordingly, a direction of remote transmission and reception of an RF signal of the first patch antenna pattern 111*a* may be focused in the upward and downward directions (e.g., +/−Z directions).

The second patch antenna pattern 112*a* may be disposed upwardly (+Z axis direction) of the ground plane 201*a*, may be spaced apart from the ground plane 201*a*, may overlap at least a portion of the first patch antenna pattern 111*a*, and may have a second bandwidth higher than the first bandwidth. For example, the second bandwidth may include 60 GHz, and may be determined by intrinsic elements of the second patch antenna pattern 112*a* (e.g., a size and a form of the second patch antenna pattern, a spacing distance of the second patch antenna pattern to the other elements, a dielectric constant of the dielectric layer, and the like).

The second patch antenna pattern 112*a* may form a radiation pattern in the upward and downward directions (e.g., +/−Z directions) as a surface current flows to an upper surface, and may remotely transmit and receive an RF signal in the upward and downward directions (e.g., +/−Z directions).

Since the second bandwidth is higher than the first bandwidth, the antenna apparatuses 100*a*, 100*b*, 100*c*, and 100*d* in the example may remotely transmit and receive a plurality of RF signals having different frequencies in the upward and downward directions (e.g., +/−Z directions) through the first and second patch antenna patterns 111*a* and 112*a*.

As at least a portion of the first patch antenna pattern 111*a* overlaps the second patch antenna pattern 112*a* in the upward and downward directions (e.g., Z direction), the antenna apparatuses 100*a*, 100*b*, 100*c*, and 100*d* in the example may remotely transmit and receive a plurality of RF signals having different frequencies in the upward and downward directions (e.g., Z direction) without increasing sizes of the antenna apparatuses 100*a*, 100*b*, 100*c*, and 100*d* in a horizontal direction (e.g., an X direction and/or a Y direction).

Since the second bandwidth is higher than the first bandwidth, a second wavelength of an RF signal remotely transmitted from and received in the second patch antenna pattern 112*a* may be shorter than a first wavelength of an RF signal remotely transmitted from and received in the first patch antenna pattern 111*a*.

First and second surface currents flowing on the first and second patch antenna patterns 111*a* and 112*a*, respectively, may be affected by the first and second wavelengths, respectively, and the first and second surface currents may be formed by resonance of the first and second patch antenna patterns 111*a* and 112*a*, respectively.

Accordingly, the first and second patch antenna patterns 111*a* and 112*a* may be configured to allow the first and second surface currents to flow in a resonance environment in which the first and second surface currents correspond to the first and second wavelengths, respectively.

Each of the plurality of guide vias 130*a* may be configured to electrically connect the first patch antenna pattern 111*a* to the ground plane 201*a*.

The plurality of guide vias 130*a* may be arranged on one side of the first patch antenna pattern 111*a*. Combination of the plurality of guide vias 130*a* may widen a width of an electrical path between the first patch antenna pattern 111*a* and the ground plane 201*a*, and may have an appropriate level of impedance such that the first surface current flowing on the first patch antenna pattern 111*a* may flow in the plurality of guide vias 130*a* in an efficient manner.

Accordingly, the first surface current flowing on the first patch antenna pattern 111*a* may flow to the ground plane 201*a* through the plurality of guide vias 130*a*. Thus, a length corresponding to resonance of the first patch antenna pattern 111*a* may correspond to a sum of a length of the first patch antenna pattern 111*a*, a length of the plurality of guide vias 130*a*, and a length of a portion of the ground plane 201*a* overlapping the first patch antenna pattern 111*a*.

Accordingly, the first patch antenna pattern 111*a* may easily have the first bandwidth less than the second bandwidth without increasing a size of the first patch antenna pattern 111*a* in the horizontal direction (e.g., X direction and/or Y direction), and even when the first patch antenna pattern 111*a* has a size similar to a size of the second patch antenna pattern 112*a* (e.g., a ratio between 80% and 120%), the first patch antenna pattern 111*a* may have a first bandwidth less than the second bandwidth (e.g., a ratio of 50%).

Each of the antenna apparatuses 100*a*, 100*b*, 100*c*, and 100*d* in the example may have a relatively small size in the horizontal direction (e.g., X direction and/or a Y direction), corresponding to the second patch antenna pattern 112*a* having the relatively high second bandwidth, and may include the first patch antenna pattern 111*a* having the first bandwidth less than the second bandwidth without increasing the sizes in the horizontal direction. Accordingly, the antenna apparatuses 100*a*, 100*b*, 100*c*, and 100*d* may remotely transmit and receive a plurality of RF signals having different frequencies in the upward and downward directions (e.g., +/−Z directions) and may be easily miniaturized.

For example, the number of the plurality of guide vias 130*a* may be three or more, and the plurality of guide vias 130*a* may be linearly arranged. Accordingly, the plurality of guide vias 130*a* may have an appropriate level of impedance such that the first surface current flowing on the first patch antenna pattern 111*a* may flow in the plurality of guide vias 130*a* in an efficient manner.

For example, the plurality of guide vias 130*a* may arranged along one side of the first patch antenna pattern 111*a* so as to close a lower space of the one side of the first patch antenna pattern 111*a* and may arranged to open a lower spaces of the other sides (e.g., three sides) of the first patch antenna pattern 111*a*.

Accordingly, the first surface current flowing on the first patch antenna pattern 111*a* may be focused in one direction, and accordingly, distribution of a length element affecting resonance of the first patch antenna pattern 111*a* may be prevented.

For example, the plurality of guide vias 130*a* may be isolated from the second patch antenna pattern 112*a*. Accordingly, the plurality of guide vias 130*a* may not interfere with formation of a radiation pattern of the first patch antenna pattern 111*a* and/or the second patch antenna pattern 112*a*, thereby improving gains of the first patch antenna pattern 111*a* and/or the second patch antenna pattern 112*a*.

For example, at least a portion of the plurality of guide vias 130*a* may overlap one side of the second patch antenna pattern 112*a*.

The first surface current flowing on the first patch antenna pattern 111*a* may be turned in one direction between the first patch antenna pattern 111*a* and the plurality of guide vias 130*a*, and accordingly, an electromagnetic boundary condition of a boundary line on which the first patch antenna pattern 111*a* is in contact with the plurality of guide vias 130*a* may be similar to an electromagnetic boundary condition of one side of the second patch antenna pattern 112*a*.

Accordingly, when at least a portion of the plurality of guide vias 130*a* overlaps one side of the second patch antenna pattern 112*a*, the first and second patch antenna patterns 111*a* and 112*a* may operate electromagnetically in a harmonious manner such that electromagnetic interference between the first and second patch antenna patterns 111*a* and 112*a* may be prevented, thereby improving gains of the first and second patch antenna patterns 111*a* and 112*a*.

The feed via 120*a* may be electrically connected to the second patch antenna pattern 112*a*. The feed via 120*a* may transmit an RF signal received from an integrated circuit (IC) to the second patch antenna pattern 112*a* during transmission, and may transmit an RF signal received from the second patch antenna pattern 112*a* to the IC during reception.

The first patch antenna pattern 111*a* may have a through-hole through which the feed via 120*a* penetrates. Accordingly, the second patch antenna pattern 112*a* may be electrically connected to the feed via 120*a* and may overlap the first patch antenna pattern 111*a* in the upward and downward directions (e.g., +/−Z directions), thereby easily reducing the sizes of the antenna apparatuses 100*a*, 100*b*, 100*c*, and 100*d*.

The feed pattern 126*a* may be electrically connected to the feed via 120*a*, may have a width greater than a width of the feed via 120*a*, and may be disposed in a through-hole of the first patch antenna pattern 111*a*.

Accordingly, the feed via 120*a* may indirectly transmit an RF signal received form an IC to the first patch antenna pattern 111*a* during transmission, and may transmit an RF signal indirectly received from the first patch antenna pattern 111*a* to the IC during reception.

Accordingly, the feed via 120*a* may provide electrical connection paths of the first and second patch antenna patterns 111*a* and 112*a* with respect to the IC.

For example, the feed via 120*a* may be disposed adjacent to the plurality of guide vias 130*a* and offset from a center of the first patch antenna pattern 111*a*. Accordingly, impedance between the first patch antenna pattern 111*a* and the feed via 120*a* may be appropriately determined such that the first surface current flowing on the first patch antenna pattern 111*a* may flow in the plurality of guide vias 130*a* in an efficient manner.

For example, the feed via 120*a* may be configured to penetrate through the through-hole of the ground plane 201*a*. A second feed pattern 127*a* may be disposed in the through-hole of the ground plane 201*a*.

Accordingly, the IC may be disposed on a level lower (−Z direction) than the ground plane 201*a*, and the ground plane 201*a* may effectively prevent electromagnetic interference between the IC and the first and second patch antenna patterns 111*a* and 112*a*.

Figure 2C:
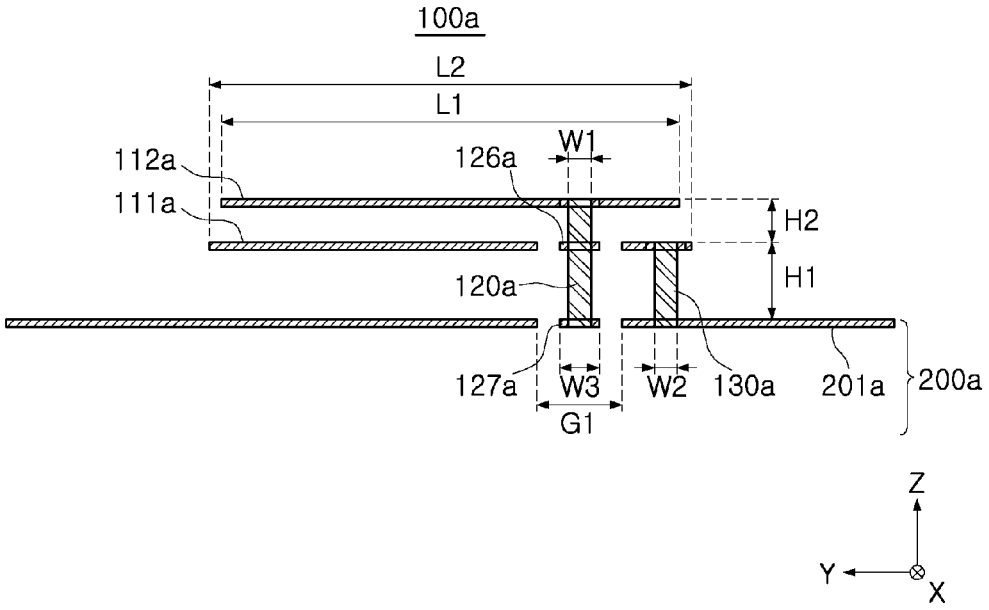
FIG. 2C is a cross-sectional view illustrating dimensions of an antenna apparatus according to an example.

FIG. 2C is a cross-sectional view illustrating dimensions of an antenna apparatus according to an example.

Referring to FIG. 2C, the first patch antenna pattern 111*a* may have a first length L1, and the second patch antenna pattern 112*a* may have a second length L2. The feed via 120*a* may have a first width W1, each of the plurality of guide vias 130*a* may have a second width W2, and the feed pattern 126*a* may have a third width W3. The through-hole of the ground plane 201*a* may have a width G1.

The feed pattern 126*a* may have the third width W3 greater than the first width W1 of the feed via 120*a*. Since the third width W3 is greater than the first width W1, the feed via 120*a* may be electrically connected to the first patch antenna pattern 111*a* by an electromagnetic coupling method without being in contact with the first patch antenna pattern 111*a*.

The first length L1 of the first patch antenna pattern 111*a* may be 0.8 times or greater and 1.2 or less than the second length L2 of the second patch antenna pattern 112*a*. The second bandwidth may include 60 GHz, and a central frequency of the first bandwidth may be included in a range of 20 GHz or higher 40 GHz and lower.

Accordingly, by including the plurality of guide vias 130*a*, the first patch antenna pattern 111*a* may have the first bandwidth lower than the second bandwidth of the second patch antenna pattern 112*a*, and may have a size similar to a size of the second patch antenna pattern 112*a*.

A spacing distance H2 between the first and second patch antenna patterns 111*a* and 112*a* may be less than a spacing distance H1 between the first patch antenna pattern 111*a* and the ground plane 201*a*.

Accordingly, a radiation pattern formed by a U-shaped structure including the first patch antenna pattern 111*a*, the plurality of guide vias 130*a*, and the ground plane 201*a* may be focused in the upward and downward directions (e.g., +/−Z directions), thereby improving a gain of the first patch antenna pattern 111*a*.

Figure 3C:
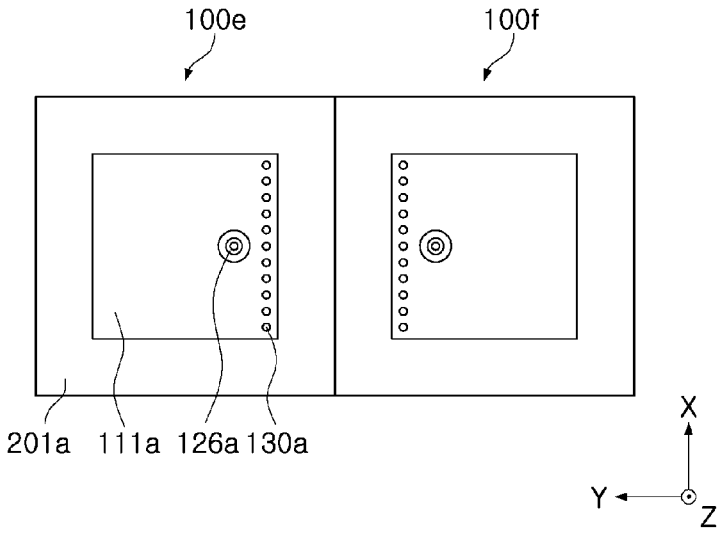
FIG. 3C is a plan view illustrating an arrangement direction of an antenna apparatus according to an example.

FIG. 3B is a plan view illustrating an antenna apparatus and a first patch antenna pattern according to an example. FIG. 3C is a plan view illustrating an arrangement direction of an antenna apparatus according to an example.

When a direction in which an RF signal is remotely transmitted and received is the upward and downward directions (e.g., +/−Z directions), an electric field of a plurality of first patch antenna patterns 111*a* may be formed in a horizontal direction and in a direction (e.g., an X direction or a Y direction) the same as a direction of a surface current, and an electrical field of the plurality of first patch antenna patterns 111*a* may be formed in a horizontal direction and in a direction perpendicular to a direction (e.g., an X direction or a Y direction) of a surface current.

The higher the number of the plurality of first patch antenna patterns 111*a*, the higher the gain of the plurality of first patch antenna patterns 111*a*. However, an electric field and a magnetic field of the plurality of first patch antenna patterns 111*a* may cause electromagnetic interference towards an adjacent first patch antenna pattern 111*a*. The electromagnetic interference may degrade a gain and/or directivity of the plurality of first patch antenna patterns 111*a*.

Referring to FIG. 3B, a plurality of guide vias 130*a* may be arranged adjacent to one side of the first patch antenna pattern 111*a* to open lower spaces of first sides (e.g., an +X direction) of the plurality of first patch antenna patterns 111*a* which do not oppose each other, and to close lower spaces of second sides opposing the first sides (e.g., an −X direction).

Accordingly, a surface current of each of the plurality of first patch antenna patterns 111*a* may be focused in a direction (e.g., an X direction) directed to a region between the first side and the second side, and the surface current may be prevented from flowing in the Y direction in the plurality of first patch antenna patterns 111*a*.

Accordingly, electromagnetic interference towards an adjacent first patch antenna pattern of the plurality of first patch antenna patterns 111*a* may be prevented, and gains and/or directivity of the antenna apparatuses 100*a*, 100*b*, 100*c*, and 100*d* in the example may improve.

For example, the plurality of first patch antenna patterns 111*a* may be arranged in a first direction (e.g., a Y direction), and the first side and the second side of each of the plurality of first patch antenna patterns 111*a* may be disposed in a direction different from the first direction in a corresponding first patch antenna pattern.

Accordingly, as a direction (e.g., an X direction) of a surface current flowing on the plurality of first patch antenna patterns 111*a* is different from the first direction (e.g., a Y direction), electromagnetic interference between the plurality of first patch antenna patterns 111*a* may decrease based on the direction of the surface current.

Referring to FIG. 3C, a plurality of guide vias 130*a* of antenna apparatuses 100*e* and 100*f* in the example may be arranged along one side adjacent to an adjacent first patch antenna pattern in the plurality of first patch antenna patterns 111*a*.

Figure 4A:
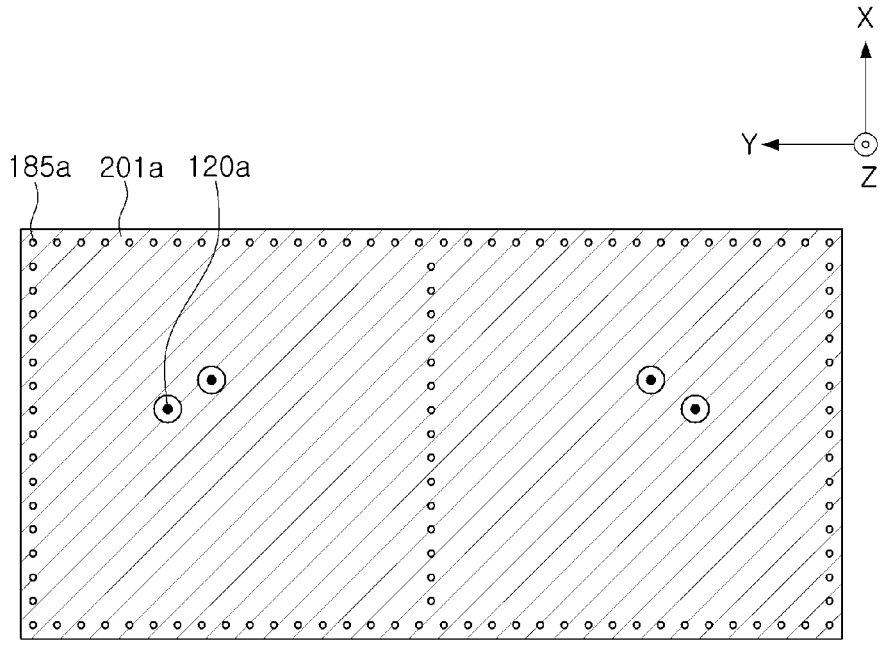
FIG. 4A is a plan view illustrating a ground plane of an antenna apparatus according to an example.
Figure 4B:
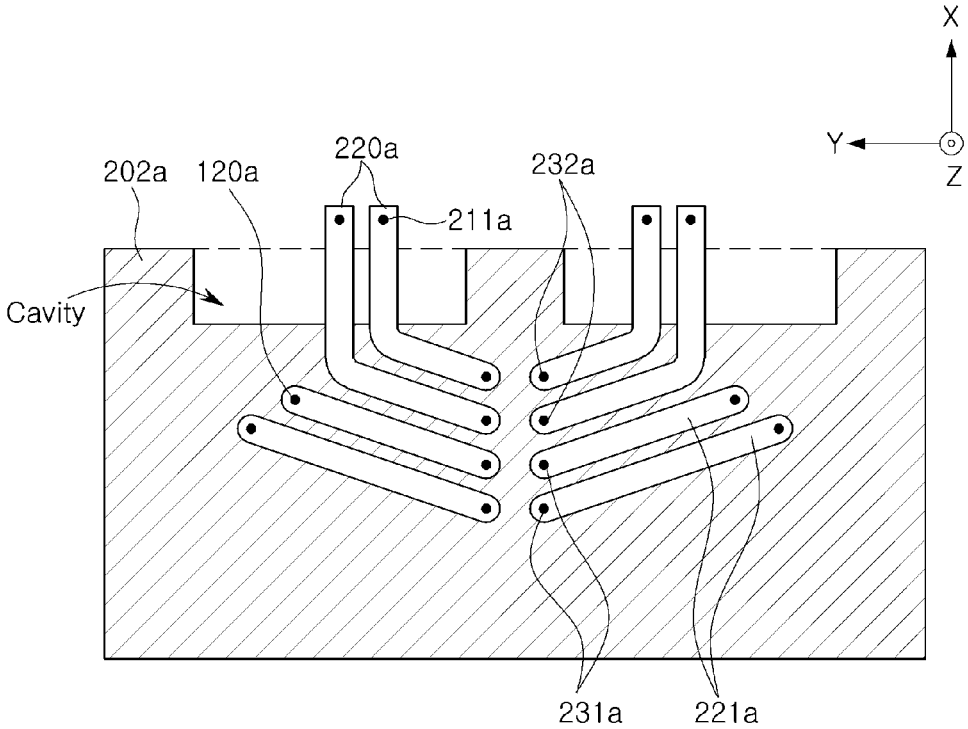
FIG. 4B is a plan view illustrating a feed line on a lower side of the ground plane illustrated in FIG. 4A.
Figure 4C:
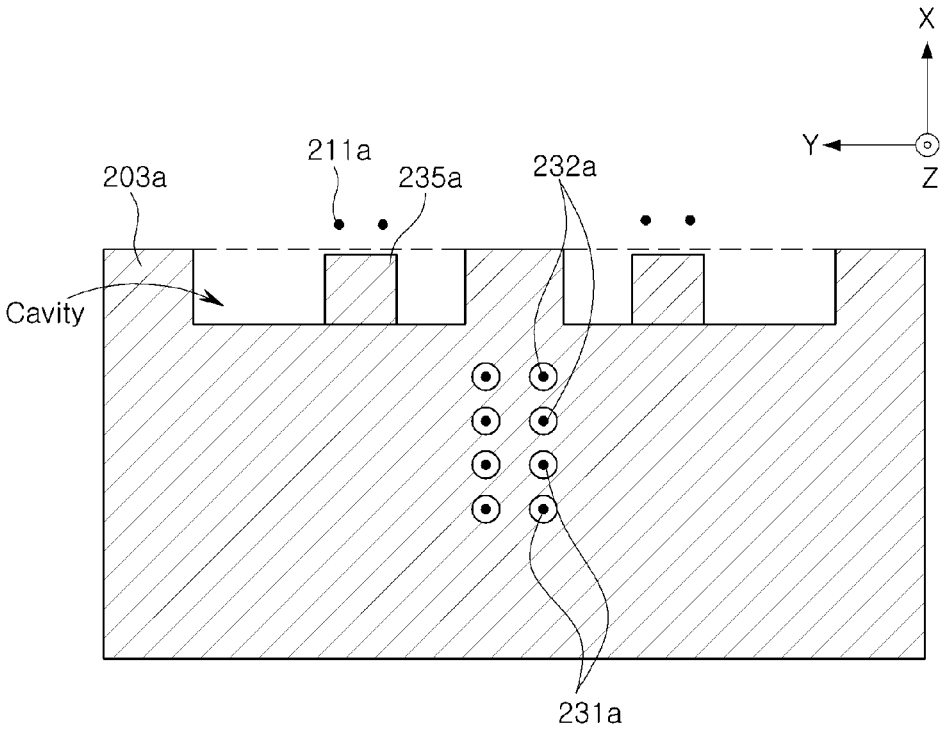
FIG. 4C is a plan view illustrating a wiring via on a lower side of a feed line and a second ground plane illustrated in FIG. 4B.
Figure 4D:
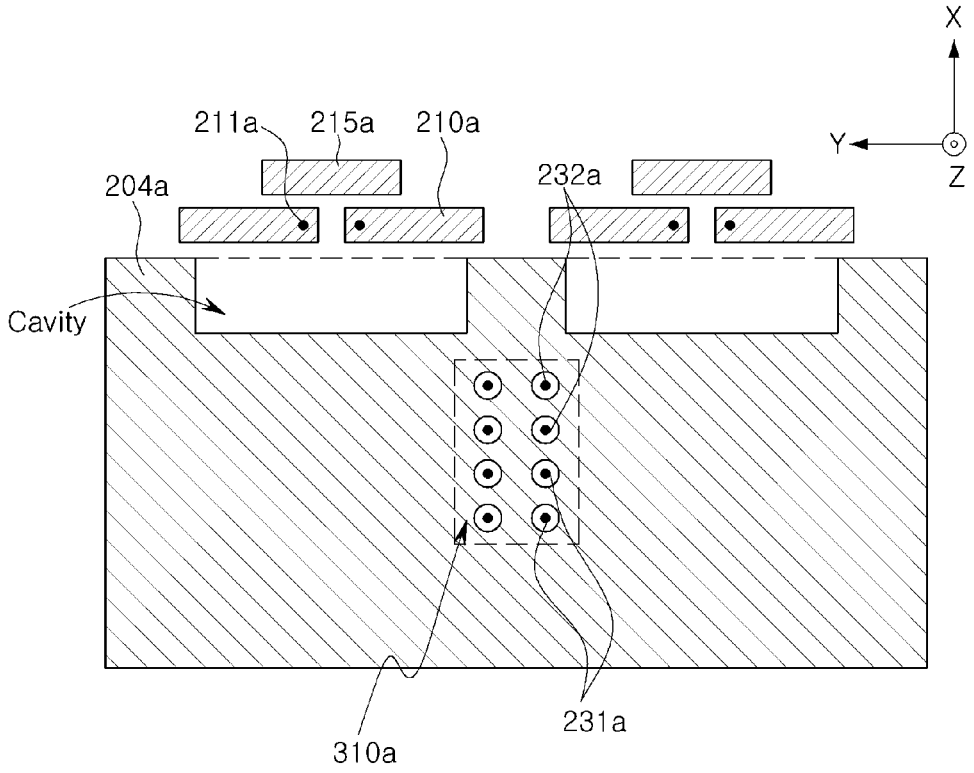
FIG. 4D is a plan view illustrating a dispositional region of an IC on a lower side of a second ground plane and an end-fire antenna illustrated in FIG. 4C.

FIG. 4A is a plan view illustrating a ground plane of an antenna apparatus according to an example. FIG. 4B is a plan view illustrating a feed line on a lower side of the ground plane illustrated in FIG. 4A. FIG. 4C is a plan view illustrating a wiring via on a lower side of a feed line and a second ground plane illustrated in FIG. 4B. FIG. 4D is a plan view illustrating a dispositional region of an IC on a lower side of a second ground plane and an end-fire antenna illustrated in FIG. 4C.

Referring to FIG. 4A, a ground plane 201*a* may have a through-hole through which a feed via 120*a* penetrates, and may electromagnetically shield a region between a patch antenna pattern and a feed line. A shielding via 185*a* may extend towards a lower side (e.g., a −Z direction).

Referring to FIG. 4B, a wiring ground plane 202*a* may surround at least a portion of an end-fire antenna feed line 220*a* and a feed line 221*a*. The end-fire antenna feed line 220*a* may be electrically connected to a second wiring via 232*a*, and the feed line 221*a* may be electrically connected to a first wiring via 231*a*. The wiring ground plane 202*a* may electromagnetically shield a region between the end-fire antenna feed line 220*a* and the feed line 221*a*. One end of the end-fire antenna feed line 220*a* may be connected to a second feed via 211*a*.

Referring to FIG. 4C, a second ground plane 203*a* may have a plurality of through-holes through which the first wiring via 231*a* and the second wiring via 232*a* penetrate, respectively, and may have a coupling ground pattern 235*a*. The second ground plane 203*a* may electromagnetically shield a region between the feed line and an IC.

Referring to FIG. 4D, an IC ground plane 204*a* may have a plurality of through-holes through which the first wiring via 231*a* and the second wiring via 232*a* penetrate, respectively. An IC 310*a* may be disposed on a lower side (−Z direction) of the IC ground plane 204*a*, and may be electrically connected to the first wiring via 231*a* and the second wiring via 232*a*. An end-fire antenna pattern 210*a* and a director pattern 215*a* may be disposed on a level the same as a level of the IC ground plane 204*a*. In other words, the end-fire antenna pattern 210*a* and the director pattern 215*a* may be coplanar with the IC ground plane 204*a* in the Z direction.

The IC ground plane 204*a* may provide a circuit of the IC 310*a* and/or a ground used in a passive component to the IC 310*a* and/or a passive component. In various examples, the IC ground plane 204*a* may provide a transmission path for power and a signal used in the IC 310*a* and/or a passive component. Accordingly, the IC ground plane 204*a* may be electrically connected to the IC 310*a* and/or a passive component.

Upward and downward (Z axis direction) relationships among the wiring ground plane 202*a*, the second ground plane 203*a*, and the IC ground plane 204*a* and forms of the wiring ground plane 202*a*, the second ground plane 203*a*, and the IC ground plane 204*a* may be varied in examples.

Figure 5A:
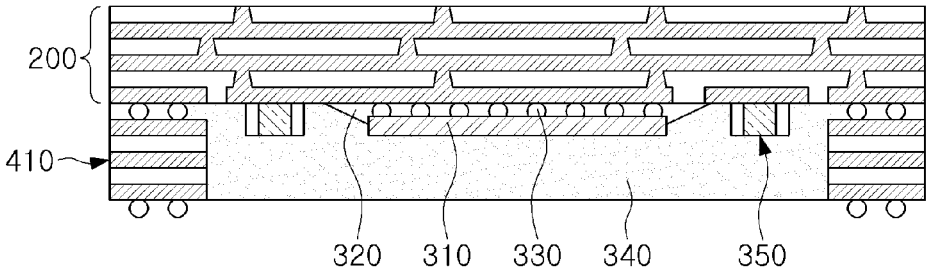
FIGS. 5A and 5B are side views illustrating a lower structure of a connection member included in an antenna apparatus according to an example.
Figure 5B:
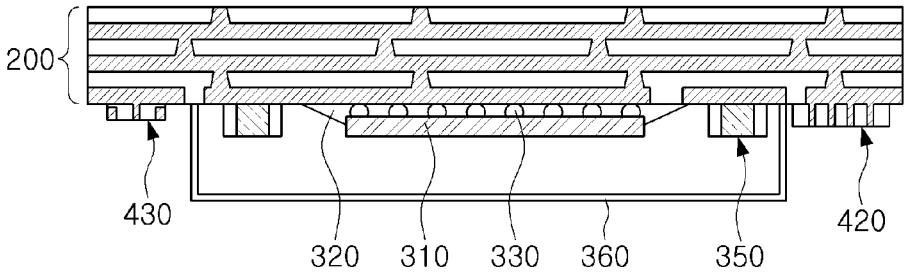

FIGS. 5A and 5B are side views illustrating a lower structure of a connection member included in an antenna apparatus according to an example.

Referring to FIG. 5A, an antenna apparatus may include at least portions of a connection member 200, an IC 310, an adhesive member 320, an electrical interconnect structure 330, an encapsulant 340, a passive component 350, and a core member 410.

The connection member 200 may have a structure in which the ground plane, the wiring ground plane, the second ground plane, the IC ground plane, and the insulating layer, described in the aforementioned examples, are layered.

The IC 310 may be the same as the above-described IC, and may be disposed on a lower side of the connection member 200. The IC 310 may be electrically connected to a wiring line of the connection member 200, and may transmit or receive an RF signal. The IC 310 may also be electrically connected to a ground plane of the connection member 200 and may be grounded. For example, the IC 310 may generate a converted signal by performing at least portions of frequency conversion, amplification, filtering, a phase control, and power generation.

The adhesive member 320 may allow the IC 310 and the connection member 200 to be bonded to each other.

The electrical interconnect structure 330 may electrically connect the IC 310 and the connection member 200 to each other. The electrical interconnect structure 330 may have a melting point lower than melting points of a wiring line and a ground plane of the connection member 200 and may electrically connect the IC 310 and the connection member 200 to each other through a required process using the low melting point.

The encapsulant 340 may encapsulate at least a portion of the IC 310, and may improve a heat dissipation performance and a protection performance against impacts. For example, the encapsulant 340 may be implemented by a photoimageable encapsulant (PIE), an Ajinomoto build-up film (ABF), an epoxy molding compound (EMC), and the like.

The passive component 350 may be disposed on a lower surface of the connection member 200, and may be electrically connected to a wiring line and/or a ground plane of the connection member 200 through the interconnect structure 330. For example, the passive component 350 may include at least portions of a capacitor (e.g., a multilayer ceramic capacitor, (MLCC)), an inductor, and a chip resistor.

The core member 410 may be disposed on a lower surface of the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency (e.g., 24 GHz, 28 GHz, 36 GHz, 39 GHz, 60 GHz) of the RF signal may be greater than a frequency (e.g., 2 GHz, 5 GHz, 10 GHz, and the like) of the IF signal.

For example, the core member 410 may transmit an IF signal or a baseband signal to the IC 310 or may receive the signal from the IC 310 through a wiring line included in an IC ground plane of the connection member 200. As a first ground plane of the connection member 200 is disposed between the IC ground plane and a wiring line, an IF signal or a baseband signal and an RF signal may be electrically isolated from each other in an antenna module.

Referring to FIG. 5B, the antenna apparatus may include at least portions of a shielding member 360, a connector 420, and a chip antenna 430.

The shielding member 360 may be disposed on a lower side of the connection member 200 and may enclose the IC 310 along with the connection member 200. For example, the shielding member 360 may cover or conformally shield the IC 310 and the passive component 350 together, or may separately cover or compartment-shield the IC 310 and the passive component 350. For example, the shielding member 360 may have a hexahedral shape in which one surface is open, and may define an accommodating space having a hexahedral form by being combined with the connection member 200. The shielding member 360 may be implemented by a material having relatively high conductivity such as copper, such that the shielding member 360 may have a skin depth, and the shielding member 360 may be electrically connected to a ground plane of the connection member 200. Accordingly, the shielding member 360 may reduce electromagnetic noise which the IC 310 and the passive component 350 receive.

The connector 420 may have a connection structure of a cable (e.g., a coaxial cable or a flexible PCB), may be electrically connected to the IC ground plane of the connection member 200, and may work similarly to the above-described sub-substrate. Accordingly, the connector 420 may be provided with an IF signal, a baseband signal, and/or power from a cable, or may provide an IF signal and/or a baseband signal to a cable.

The chip antenna 430 may transmit or receive an RF signal in addition to the antenna apparatus. For example, the chip antenna 430 may include a dielectric block having a dielectric constant higher than a dielectric constant of an insulating layer, and a plurality of electrodes disposed on both surfaces of the dielectric block. One of the plurality of electrodes may be electrically connected to a wiring line of the connection member 200, and the other one of the plurality of electrodes may be electrically connected to a ground plane of the connection member 200.

Figure 6:
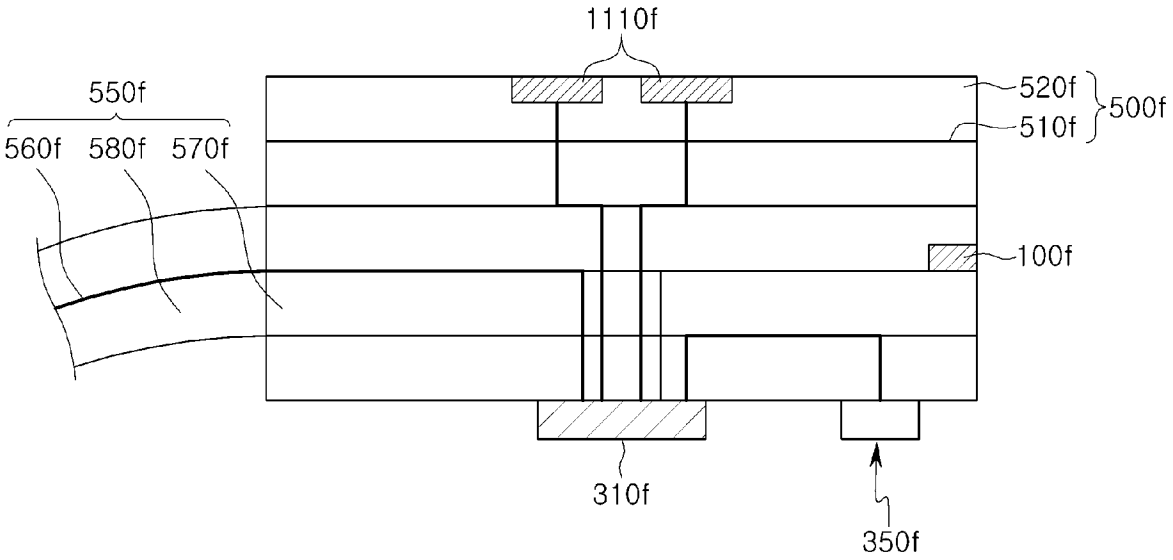
FIG. 6 is a side view illustrating an example structure of an antenna apparatus according to an example.

FIG. 6 is a side view illustrating a structure of an antenna apparatus according to an example.

Referring to FIG. 6, an antenna apparatus may have a structure in which an end-fire antenna 100*f*, a patch antenna pattern 1110*f*, an IC 310*f*, and a passive component 350*f* are integrated to a connection member 500*f*.

The end-fire antenna 100*f* and the patch antenna pattern 1110*f* may be configured the same as the antenna apparatus and the patch antenna pattern described in the aforementioned examples, may receive an RF signal from the IC 310*f* and may transmit the RF signal, or may transmit a received RF signal to the IC 310*f*.

The connection member 500*f* may have a structure in which at least one conductive layer 510*f* and at least one insulating layer 520*f* are laminated (e.g., a structure of a printed circuit board). The conductive layer 510*f* may include the ground plane and the feed line described in the aforementioned examples.

The antenna apparatus in the example may further include a flexible connection member 550*f*. The flexible connection member 550*f* may include a first flexible region 570*f* overlapping the connection member 500*f* and a second flexible region 580*f* which does not overlap the connection member 500*f* in the upward and downward directions.

The second flexible region 580*f* may be flexibly bent in upward and downward directions. Accordingly, the second flexible region 580*f* may be flexibly connected to a connector of a set substrate and/or an adjacent antenna apparatus.

The flexible connection member 550*f* may include a signal line 560*f*. An intermediate frequency (IF) signal and/or a baseband signal may be transmitted to the IC 310*f* or may be transmitted to a connector of a set substrate and/or an adjacent antenna apparatus through the signal line 560*f*.

Figure 7A:
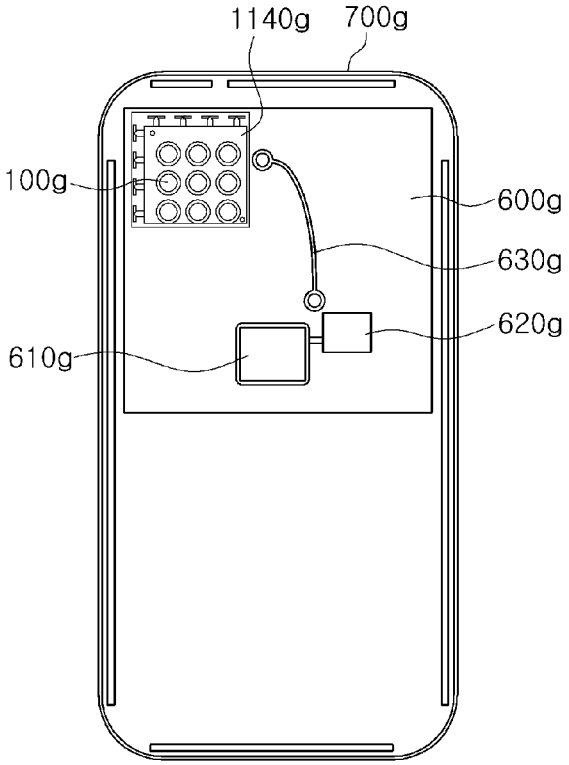
FIGS. 7A, 7B, and 7C are plan views illustrating an example of an electronic device in which an antenna apparatus is disposed.
Figure 7B:
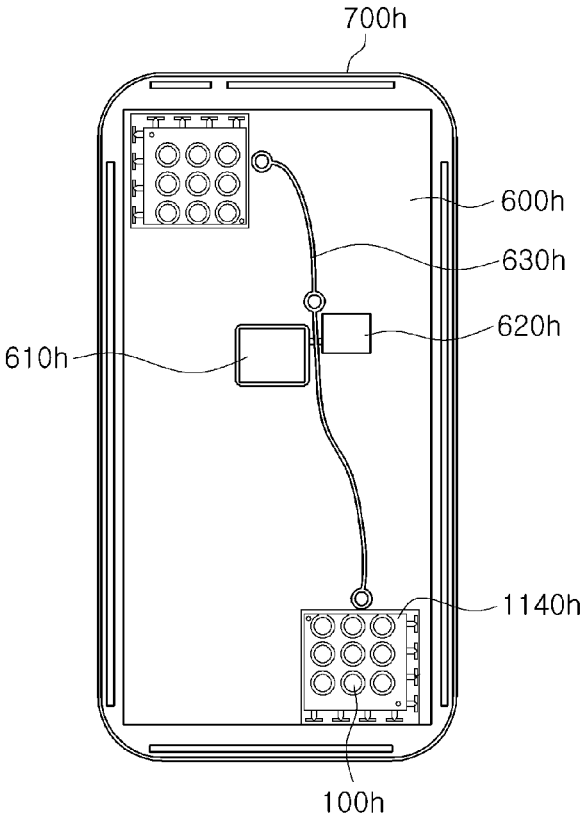
Figure 7C:
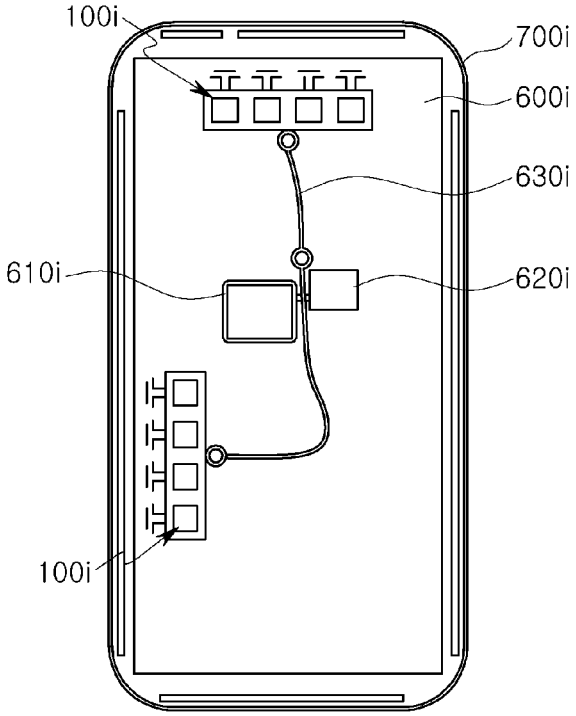

FIGS. 7A, 7B, and 7C are plan views illustrating an example of an electronic device in which an antenna apparatus is disposed.

Referring to FIG. 7A, an antenna module 1140*g* including an antenna portion 100*g* may be disposed adjacent to a side surface boundary of an electronic device 700*g* on a set substrate 600*g* of the electronic device 700*g*.

The electronic device 700*g* may be implemented as a smartphone, a personal digital assistant, a digital video camera, a digital still camera, a network system, a computer, a monitor, a tablet PC, a laptop PC, a netbook PC, a television, a video game, a smart watch, an Automotive component, or the like, but an example of the electronic device 700*g* is not limited thereto.

A communication module 610*g* and a baseband circuit 620*g* may further be disposed on the set substrate 600*g*. The antenna module 1140*g* may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna module through a cable.

For example, the base signal may be transferred to an IC through an electrical interconnect structure, a cover via, and a wiring line. The IC may convert the base signal into an RF signal of mmWave band.

Referring to FIG. 7B, a plurality of antenna modules 1140*h* each including an antenna portion 100*h* may be disposed adjacent to a one side boundary and the other side boundary of an electronic device 700*h* on a set substrate 600*h* of the electronic device 700*h*, and a communication module 610*h* and a baseband circuit 620*h* may further be disposed on the set substrate 600*h*. The plurality of antenna modules 1140*h* may be electrically connected to the communication module 610*h* and/or baseband circuit 620*h* through a coaxial cable 630*h*.

Referring to FIG. 7C, a plurality of antenna modules each including an antenna portion 100*i* may be disposed adjacent to centers of sides of an electronic device 700*i* having a polygonal shape, respectively, on a set substrate 600*i* of the electronic device 700*i*, and a communication module 610*i* and a baseband circuit 620*i* may further be disposed on the set substrate 600*i*. The antenna apparatus may be electrically connected to the communication module 610*i* and/or the baseband circuit 620*i* through a coaxial cable 630*i*.

The patch antenna pattern, the feed via, the guide via, the feed pattern, the ground plane, the feed line, the electrical interconnect structure may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

The dielectric layer and the insulating layer described in the various examples may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, prepreg, a Ajinomoto build-up film (ABF), FR-4, bismaleimide triazine (BT), a photoimagable dielectric (PID) resin, a general copper clad laminate (CCL), glass or a ceramic-based insulating material, or the like. The dielectric layer and the insulating layer may fill at least a portion of a position in which the patch antenna pattern, the feed via, the guide via, the feed pattern, the ground plane, the feed line, the electrical interconnect structure are not disposed in the antenna apparatus described in the aforementioned examples.

The RF signal described in the various examples may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but not limited thereto.

According to the aforementioned examples, the antenna apparatus may have improved antenna performances (e.g., a gain, a bandwidth, directivity, and the like) and may be easily miniaturized.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a ground plane;

a first patch antenna pattern having a first bandwidth and spaced apart from the ground plane;

a second patch antenna pattern spaced apart from the ground plane and the first patch antenna and overlapping at least a portion of the first patch antenna pattern, the second patch antenna pattern having a second bandwidth corresponding a frequency higher than a frequency of the first bandwidth; and guide vias disposed between the first patch antenna pattern and the ground plane and electrically connecting the first patch antenna pattern to the ground plane, wherein the guide vias are disposed along a first side of the first patch antenna pattern.

2. The antenna apparatus of claim 1, wherein the guide vias comprise three or more guide vias, and the guide vias are arranged linearly.

3. The antenna apparatus of claim 1, wherein the first patch antenna pattern has a polygonal shape, and wherein the guide vias are arranged to open sides of the first patch antenna pattern other than the first side.

4. The antenna apparatus of claim 1, wherein at least a portion of the guide vias overlaps a boundary of the second patch antenna pattern.

5. The antenna apparatus of claim 1, wherein the second patch antenna pattern is spaced apart from the ground plane more than the first patch antenna pattern such that the first patch antenna pattern is disposed between the second patch antenna pattern and the ground plane, and wherein a spacing distance between the first patch antenna pattern and the second patch antenna pattern is less than a spacing distance between the first patch antenna pattern and the ground plane.

6. The antenna apparatus of claim 1, wherein the second bandwidth includes 60 GHz, and wherein a central frequency of the first bandwidth is included in a range of 20 GHz to 40 GHz.

7. The antenna apparatus of claim 6, wherein a length of the first patch antenna pattern taken in a first direction is 0.8 to 1.2 times a length of the second patch antenna pattern taken in the first direction.

8. The antenna apparatus of claim 1, further comprising:

a feed via electrically connected to the second patch antenna pattern, wherein the first patch antenna pattern comprises a through-hole through which the feed via penetrates.

9. The antenna apparatus of claim 8, wherein the feed via is disposed adjacent to the plurality of guide vias and offset from a center of the first patch antenna pattern.

10. The antenna apparatus of claim 8, further comprising:

a feed pattern electrically connected to the feed via and disposed in the through-hole of the first patch antenna pattern, the feed pattern having a width greater than a width of the feed via.

11. The antenna apparatus of claim 8, wherein the guide vias are separated from the second patch antenna pattern.

12. An antenna apparatus, comprising:

a ground plane;

first patch antenna patterns each having a polygonal shape and being spaced apart from the ground plane;

second patch antenna patterns spaced apart from the first patch antenna patterns; and guide vias disposed between the first patch antenna patterns and the ground plane and electrically connecting the first patch antenna patterns to the ground plane, wherein the guide vias are arranged to open first sides of the first patch antenna patterns that do not oppose each other, and are arranged along second sides opposing the first sides of the first patch antenna patterns, and wherein a spacing distance between the first patch antenna patterns and the second patch antenna patterns is less than a spacing distance between the first patch antenna patterns and the ground plane.

13. The antenna apparatus of claim 12, wherein the first patch antenna patterns are arranged in a first direction, and wherein a second direction from the second side to the first side of each of the first patch antenna patterns is different from the first direction.

14. The antenna apparatus of claim 12, further comprising:

feed vias electrically connected to the second patch antenna patterns, wherein each of the first patch antenna patterns comprises a through-hole through which a corresponding feed via of the feed vias penetrates, and wherein the feed vias are configured to indirectly feed power to a corresponding first patch antenna pattern.

15. The antenna apparatus of claim 14, further comprising:

feed lines electrically connected to a corresponding feed via of the feed vias and spaced apart from the ground plane, wherein the ground plane comprises at least one through-hole through which the feed vias penetrate.

16. An antenna apparatus, comprising:

a ground plane;

a first patch antenna pattern, spaced apart from the ground plane in a first direction;

a second patch antenna pattern, spaced apart from the ground plane in the first direction and overlapping at least a portion of the first patch antenna pattern such that the first patch antenna pattern is disposed between the second patch antenna pattern and the ground plane in the first direction; and guide vias, electrically connecting the first patch antenna pattern to the ground plane and disposed linearly along a first surface of the first patch antenna pattern that is substantially perpendicular to the first direction, wherein a spacing distance between the first patch antenna pattern and the second patch antenna pattern is less than a spacing distance between the first patch antenna pattern and the ground plane.

* * * * *